US010723544B2

(12) United States Patent
Wallis

(10) Patent No.: US 10,723,544 B2
(45) Date of Patent: Jul. 28, 2020

(54) SHOWER ENCLOSURE SYSTEM FOR ALIGNING LOWER AND UPPER ENCLOSURE MEMBERS

(71) Applicant: Danny Wallis, Newport Beach, CA (US)

(72) Inventor: Danny Wallis, Newport Beach, CA (US)

( * ) Notice: Subject to any disclaimer, the term of this patent is extended or adjusted under 35 U.S.C. 154(b) by 0 days.

(21) Appl. No.: 16/460,923

(22) Filed: Jul. 2, 2019

(65) Prior Publication Data

US 2020/0115144 A1 Apr. 16, 2020

Related U.S. Application Data

(63) Continuation of application No. 16/031,922, filed on Jul. 10, 2018, now Pat. No. 10,336,527, which is a continuation of application No. 13/802,009, filed on Mar. 13, 2013, now Pat. No. 10,336,527.

(60) Provisional application No. 61/621,909, filed on Apr. 9, 2012.

(51) Int. Cl.

| | |
|---|---|
| ***A47K 3/00*** | (2006.01) |
| ***B65D 85/00*** | (2006.01) |
| ***A47K 3/28*** | (2006.01) |

(52) U.S. Cl.

CPC ..... *B65D 85/00* (2013.01); *A47K 3/284* (2013.01); *Y10T 29/49826* (2015.01)

(58) Field of Classification Search

CPC ..... A47K 3/284
USPC ..... 4/599, 612; 52/34, 35
See application file for complete search history.

(56) References Cited

U.S. PATENT DOCUMENTS

| | | | |
|---|---|---|---|
| 2,343,201 | A | 2/1944 | Nilson |
| 2,592,244 | A | 4/1952 | Chamberlain |
| 3,350,827 | A | 11/1967 | Sugar |
| 3,382,635 | A | 5/1968 | O'Gara et al. |
| 3,817,012 | A | 6/1974 | Wack et al. |
| 3,992,825 | A | 11/1976 | May |
| 4,901,380 | A | 2/1990 | Smith |
| 4,920,716 | A | 5/1990 | Coffey |
| 4,993,201 | A | 2/1991 | Bunyard |
| 5,142,836 | A | 9/1992 | Kearns |
| 5,331,778 | A | 7/1994 | Mazpule et al. |
| 5,544,369 | A | 8/1996 | Roberts |
| 5,671,489 | A | 9/1997 | Salach |
| 5,816,005 | A | 10/1998 | Han |
| 5,845,347 | A | 12/1998 | Young |

(Continued)

FOREIGN PATENT DOCUMENTS

| | | | |
|---|---|---|---|
| DE | 9010579 | U1 | 10/1990 |
| EP | 2181631 | A1 | 5/2010 |

*Primary Examiner* — Lauren A Crane

(57) ABSTRACT

A shower wall system is mounted to a wall frame having a plurality of vertical studs. The system comprises a plurality of attachment pieces, a lower piece, and an upper piece. Each attachment piece is attached to a stud, and either the lower or upper piece is attached to attachment pieces. The lower piece is aligned to the upper piece by a wall alignment assembly. The wall alignment assembly comprises a first alignment member proximate the top portion of the lower piece that mates with a second alignment member near the bottom portion of the one upper piece. The alignment members are configured to mate together in at least a partially interlocking manner, and the plurality of attachment pieces are positioned relative to the wall frame so that the upper piece is aligned with the lower piece regardless of whether the wall frame studs are co-planar and plumb.

16 Claims, 12 Drawing Sheets

(56) References Cited

U.S. PATENT DOCUMENTS

| | | | |
|---|---|---|---|
| 5,913,777 | A | 6/1999 | Gerber |
| 6,330,774 | B1 | 12/2001 | Weinstein |
| 6,332,299 | B1 | 12/2001 | Stewart, III |
| 6,643,863 | B1 | 11/2003 | Gerber |
| 6,675,403 | B2 | 1/2004 | Akhtar et al. |
| 7,287,287 | B2 | 10/2007 | Wegdam et al. |
| 7,493,732 | B2 | 2/2009 | Brailsford et al. |
| 7,634,823 | B2 | 12/2009 | Sisk |
| 7,749,346 | B1 | 7/2010 | Truong |
| 3,069,506 | A1 | 12/2011 | Hammond |
| 8,095,999 | B2 | 1/2012 | Wilson et al. |
| 8,096,000 | B2 | 1/2012 | Helmetsie et al. |
| 8,096,093 | B1 | 1/2012 | Poon |
| 2006/0260250 | A1 | 11/2006 | Sieg |
| 2012/0023656 | A1 | 2/2012 | Sandoval |

SHOWER ENCLOSURE SYSTEM FOR ALIGNING LOWER AND UPPER ENCLOSURE MEMBERS

RELATED APPLICATIONS

This application is a continuation and claims the benefit of U.S., patent application Ser. No. 16/031,922, filed Jul. 10, 2018, and entitled "SHOWER ENCLOSURE SYSTEM FOR ALIGNING LOWER AND UPPER ENCLOSURE MEMBERS," now U.S. Pat. No. 10,366,527, which claims priority to U.S. patent application Ser. No. 13/802,009, filed Mar. 13, 2013, and entitled "ENCLOSURE AND METHOD FOR. FORMING AN ENCLOSURE," now U.S. Pat. No. 10,017,320, which claims priority to U.S. Provisional Patent Application No. 61/621,909, filed Apr. 9, 2012, and entitled "ENCLOSURE AND METHOD FOR FORMING AN ENCLOSURE." The entire disclosures of all preceding applications are incorporated by reference herein.

BACKGROUND INFORMATION

Procedures for forming an enclosure, for example forming a watertight shower enclosure, typically involve securing one or more substrate boards to a frame, e.g., wall studs, so that the substrate boards are in an upright position, subsequently affixing one or more ornamental features, such as tiles or stones, to the substrate boards, and then applying a sealer material between the ornamental features to seal the joint between adjacent ornamental features. Unfortunately, such procedures for forming the enclosure result in certain drawbacks for the installer. For example, the substrate boards are often heavy and very flexible prior to installation, which can make the installation process very difficult. Additionally, affixing the ornamental features after the substrate boards have been installed in an upright position can be problematic as the ornamental features may tend to remove due to the forces of gravity, which can result in a sloppy looking finished product. Further, the wall studs to which the substrate boards are secured may include certain imperfections or abnormalities, e.g., knots, warping, wall studs that are out-of-plumb, etc. Consequently, the materials attached to the wall studs can likewise mimic the configuration of the wall studs, which may adversely impact the quality of the installation, and, thus, the quality and appearance of the finished product.

SUMMARY OF THE DISCLOSURE

The present invention is directed toward an enclosure comprising a base, a first substrate and a plurality of first ornamental features. The first substrate is selectively movable between a disassembled configuration and an assembled configuration, the first substrate being disconnected from the base when in the unassembled configuration, and the first substrate being coupled to the base when in the assembled configuration so that the first substrate is in a substantially upright position. The plurality of first ornamental features are individually affixed to the first substrate while the first substrate is in the disassembled configuration.

In one embodiment, the enclosure further comprises a first sealer that seals joints between adjacent first ornamental features that are affixed to the first substrate while the first substrate is in the disassembled configuration.

Additionally, in one embodiment, the first substrate and the first ornamental features that are affixed to the first substrate have a combined first weight, the first substrate has a second weight, and the ratio of the first weight to the second weight is at least approximately 3:1.

In some embodiments, the enclosure can further comprise a second substrate and a plurality of second ornamental features. The second substrate is selectively movable between a disassembled configuration and an assembled configuration, the second substrate being disconnected from the base when in the unassembled configuration, and the second substrate being coupled to the base when in the assembled configuration so that the second substrate is in a substantially upright position. The plurality of second ornamental features are individually affixed to the second substrate while the second substrate is in the disassembled configuration. In one such embodiment, the second substrate is coupled to the first substrate when the second substrate is in the assembled configuration.

Further, in certain embodiments, the enclosure further comprises a third substrate and a plurality of third ornamental features. The third substrate is selectively movable between a disassembled configuration and an assembled configuration, the third substrate being disconnected from the base when in the unassembled configuration, and the third substrate being coupled to the base when in the assembled configuration so that the third substrate is in a substantially upright position. The plurality of third ornamental features are individually affixed to the third substrate while the third substrate is in the disassembled configuration. In one such embodiment, the third substrate is coupled to one or more of the first substrate and the second substrate when the third substrate is in the assembled configuration.

Additionally, in one embodiment, the plurality of first ornamental features comprises one of a plurality of tiles and a plurality of stones.

In another embodiment, the present invention is directed toward an enclosure comprising (i) a first substrate that is selectively movable between a disassembled configuration and an assembled configuration, the first substrate having a first weight; and (ii) one or more first ornamental features that are affixed to the first substrate, the first ornamental features and the first substrate having a combines second weight, wherein the ratio of the second weight to the first weight is at least approximately 3:1.

In still another embodiment, the present invention is further directed toward a method for forming an enclosure, the method comprising the steps of (i) individually affixing a plurality of first ornamental features to a first substrate while the first substrate is disconnected from a base; and (ii) coupling the first substrate with the first ornamental features affixed thereto to the base so that the first substrate is in a substantially upright position.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts.

DETAILED DESCRIPTION OF EXAMPLE EMBODIMENTS

Figure 1A:
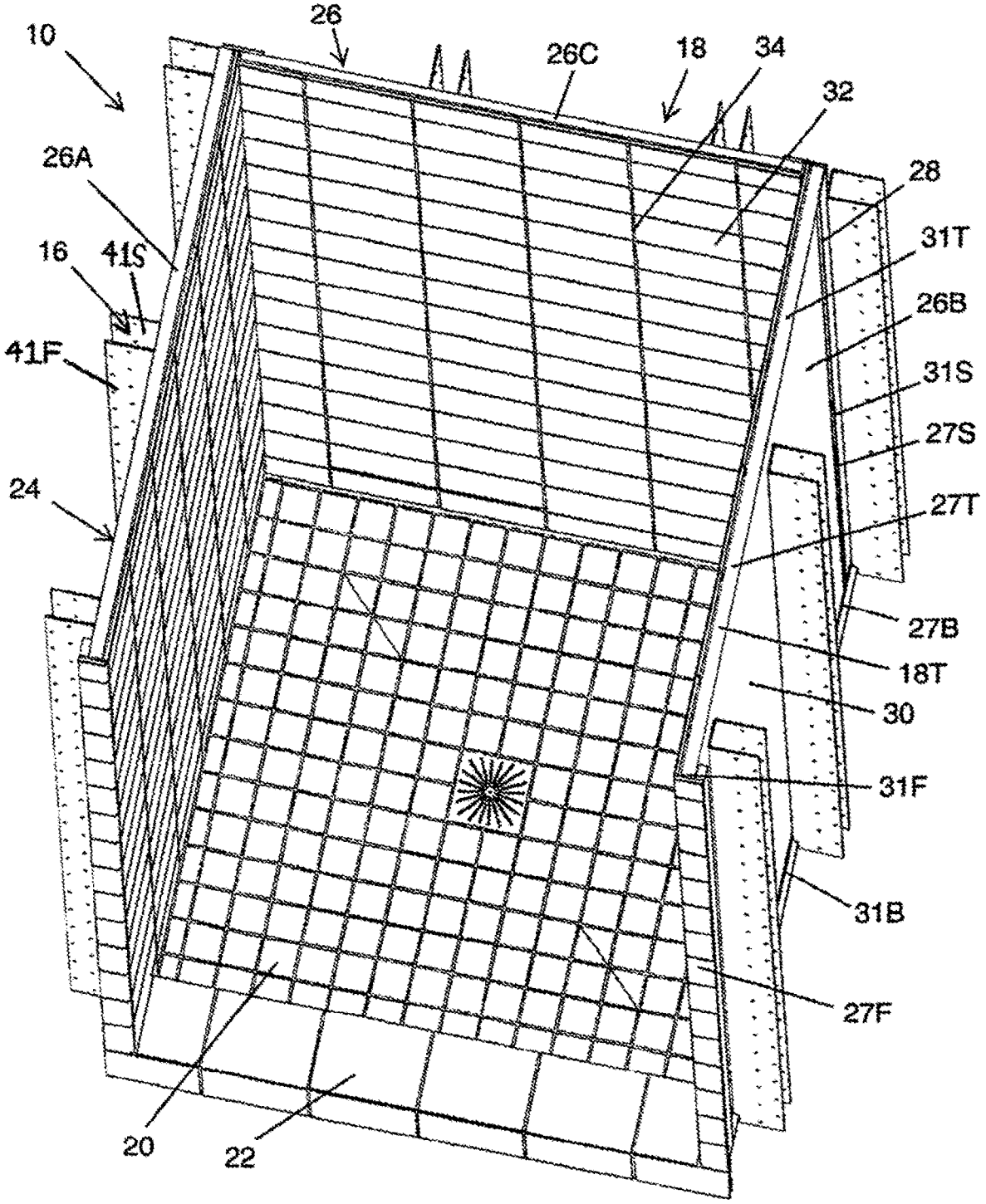
FIG. 1A is a top perspective view of an embodiment of an enclosure assembly having features of the present invention.
Figure 1B:
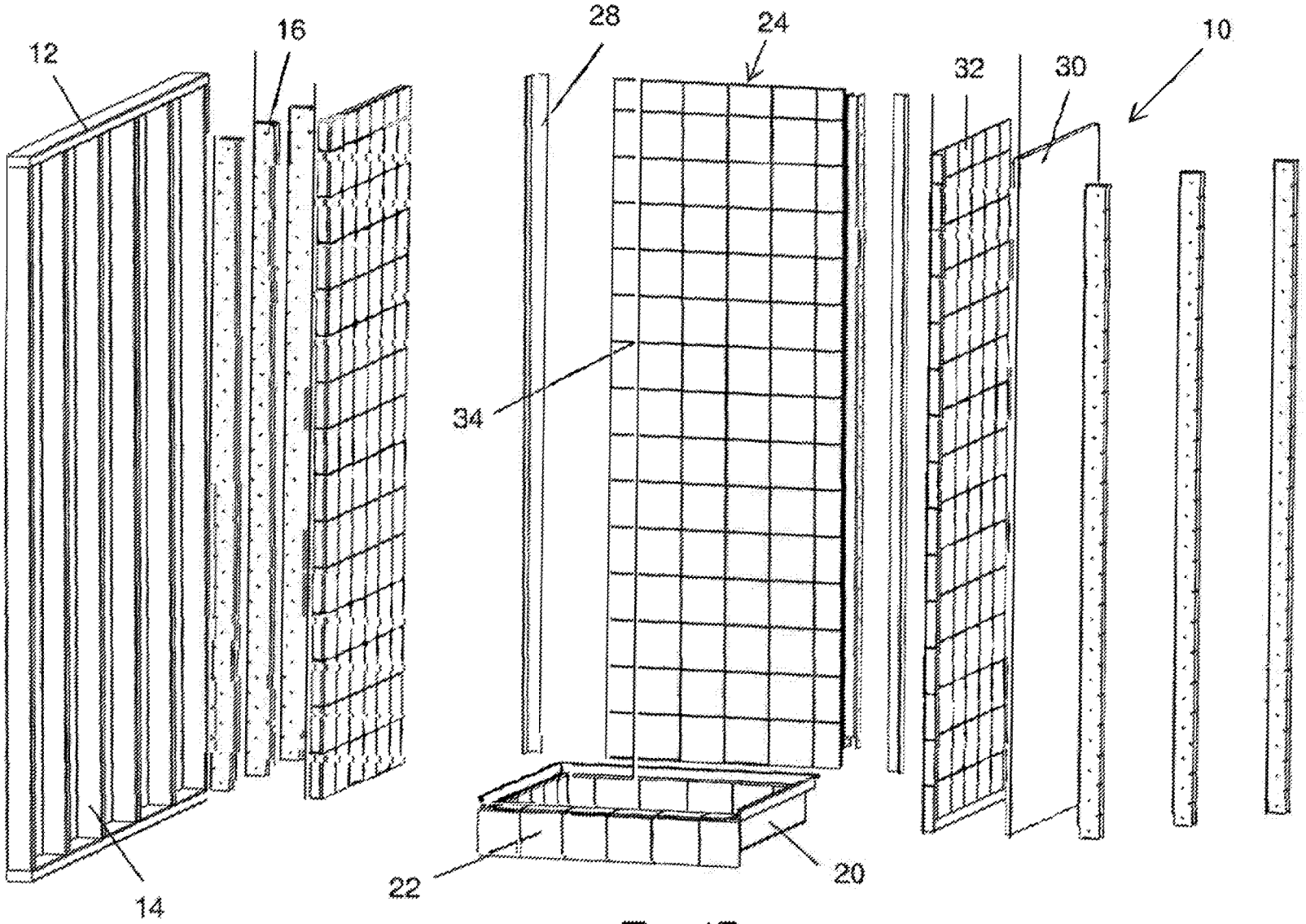
FIG. 1B is a partially exploded view of the enclosure assembly illustrated in FIG. 1A and a portion of a frame to which the enclosure assembly may be secured.

FIG. 1A is a top perspective view of an embodiment of an enclosure assembly 10 having features of the present invention. In certain embodiments, the enclosure assembly 10 is designed to be affixed to and/or mounted onto or adjacent to a frame 12 (a portion of which is illustrated in FIG. 1B). The size and shape of the frame 12 can be varied or constructed to suit the desired size and shape of the enclosure assembly 10. In one embodiment, the frame 12 can include a plurality of vertically-oriented wall studs 14 (illustrated in FIG. 1B, and also referred to herein simply as "studs"), to which the enclosure assembly 10 can be secured. The positioning and the spacing of the studs 14 can be varied as desired, such as 16 inches on center, as one non-exclusive example. For example, in one embodiment, the studs 14 are positioned relative to one another to allow for the creation of a substantially rectangular-shaped enclosure assembly 10 that can be secured to the frame 12. Additionally, in certain embodiments, the studs 14 can be spaced apart from one another by approximately sixteen inches. Alternatively, the studs 14 can be positioned relative to one another to allow for the creation of an enclosure assembly 10 having a different shape, e.g., square-shaped, triangle-shaped, pentagon-shaped, hexagon-shaped, octagon-shaped, circle-shaped, oval-shaped, or another suitable shape, and/or the studs 14 can be spaced a different distance from one another.

The design of the enclosure assembly 10 can be varied. In the embodiment illustrated in FIG. 1A, the enclosure assembly 10 includes a plurality of attachment sleeves 16 and an enclosure 18 that is adapted to be secured to the attachment sleeves 16. Additionally, in this embodiment, the enclosure 18 can include a base 20, a curb 22, and a wall assembly 24. Further, as illustrated, the wall assembly 24 can include one or more walls 26, e.g., a first side wall 26A, a second side wall 268; and a rear wall 26C as illustrated in FIG. 1A, that can each be connected to the adjacent walls 26 with a wall connector 28. Still further, in this embodiment, each of the walls 26 is positioned at an angle relative to each of the adjacent walls 26 such that no single wall 26 is adjacent to and coplanar with one of the other walls 26. Moreover, each of the walls 26 can comprise a single substrate board 30 (also sometimes referred to herein simply as a "substrate"), a plurality of ornamental features 32 and/or a sealer 34 that can be selectively secured to the substrate 30 and/or the ornamental features 32. With each wall 26 only including a single substrate 30, in certain embodiments, each substrate 30 has a top substrate edge 31T, a bottom substrate edge 31B, a first lateral substrate edge 31F and a second lateral substrate edge 31 S that provide, form and/or substantially coincide with a top wall edge 27F, a bottom wall edge 27B, a first lateral wall edge 27F and a second lateral wall edge 27S, respectively, of the wall 26. Alternatively, the enclosure assembly 10 can include greater or fewer elements than specifically illustrated in FIG. 1A For example, the enclosure assembly 10 can be designed without the curb 22 and/or other identified elements.

It should be noted that the use of the terms "first side wall" and "second side wall" is merely for purposes of illustration and ease of description, and either of the side walls 226A, 2268 can be labeled the "first side wall" and/or the "second side wall."

Figure 2A:
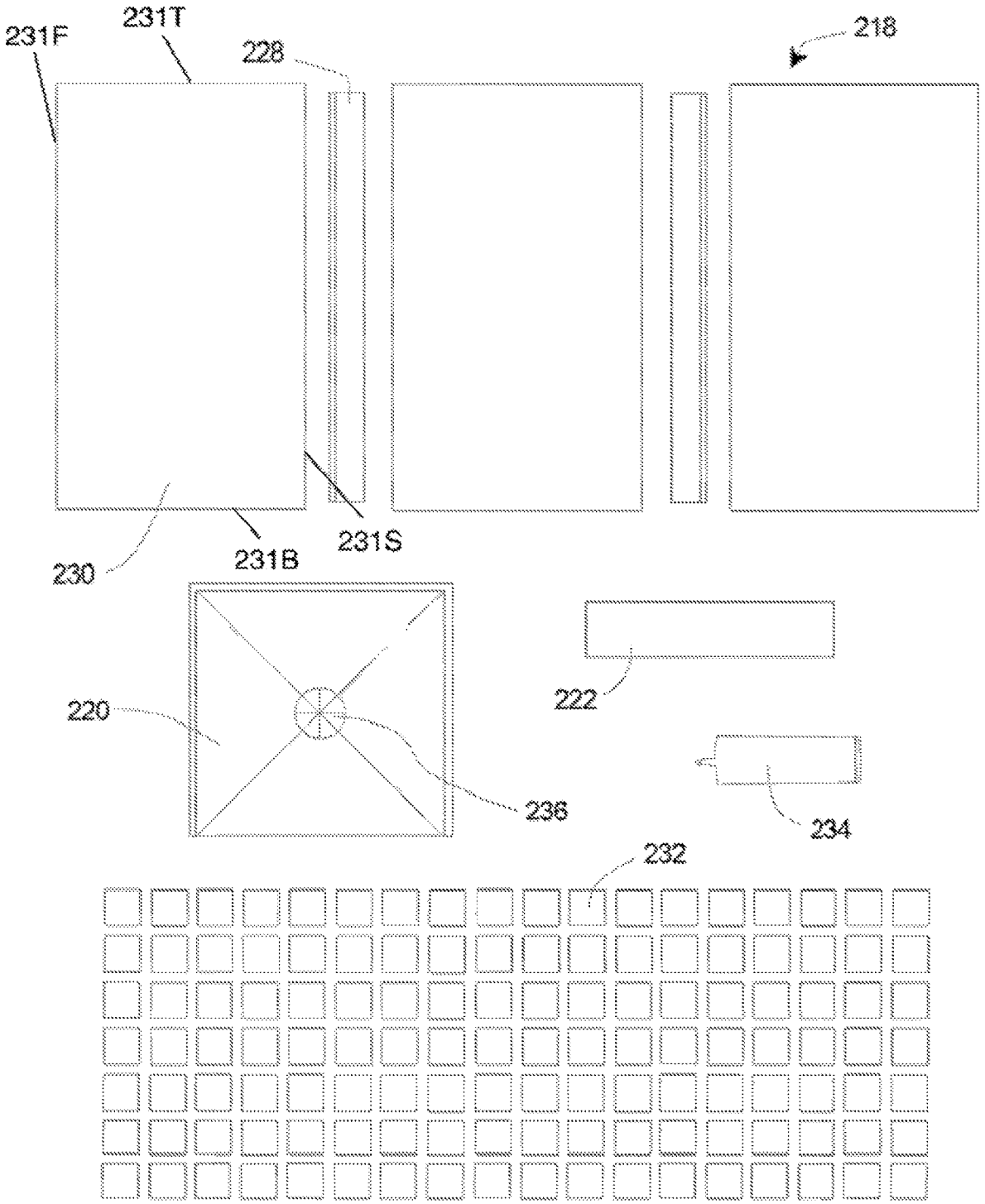
FIG. 2A is a simplified schematic illustration of an embodiment of an enclosure having features of the present invention that is usable as part of the enclosure assembly of FIG. 1A, the enclosure being in an unassembled configuration.
Figure 2B:
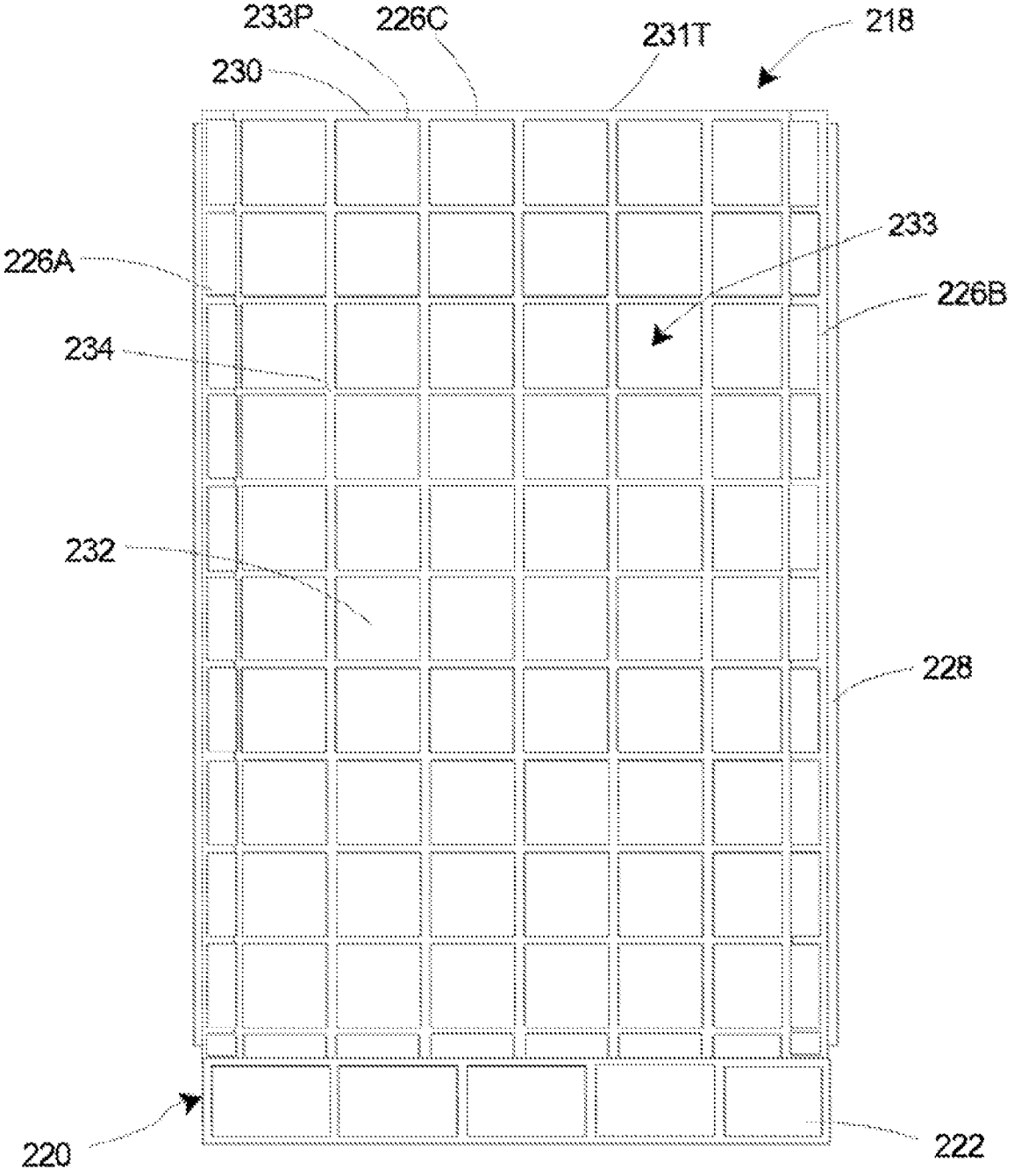
FIG. 2B is a simplified schematic illustration of the enclosure illustrated in FIG. 2A, the enclosure being in an assembled configuration.

As an overview, in certain embodiments, the enclosure 18 is designed to be selectively movable between an unassembled configuration (illustrated in FIG. 2A) and an assembled configuration (illustrated in FIG. 2B). More particularly, the enclosure 18 is uniquely designed so that each of the elements of the enclosure 18, e.g., the base 20, the curb 22 (when included), the substrates 30, the ornamental features 32 and the sealer 34, can individually and selectively be moved from the unassembled configuration to the assembled configuration. As illustrated in the drawings, when the enclosure 18 is in the assembled configuration, each of the walls 26 is coupled to the base 20 and substantially directly adjacent to the base 20 so that the walls 16 are in a substantially upright configuration. As described in detail herein, the enclosure 18 can include the one or more substrates 30 that can be formed to have a lightweight, yet sturdy construction. Moreover, the plurality of ornamental features 32, such as tiles or stones as non-exclusive examples, can be individually affixed and/or affixed in sections containing multiple ornamental features 32 to one or more of the substrates 30 while the substrates 30 are in the unassembled configuration. In certain embodiments, the plurality of ornamental features 32 can be affixed to one side of the substrate 30 such that the plurality of ornamental features 32 are collectively positioned substantially adjacent to each of the top substrate edge 31T, the bottom substrate edge 31B, the first lateral substrate edge 31 F and the second lateral substrate edge 31S. For example, in one such embodiment the plurality of ornamental features 32 can be affixed to one side of the substrate 30 so as to cover substantially the entire side of the substrate 30 while the substrate 30 is in the unassembled configuration. Further, the sealer 34, if used, can be applied between and/or around each of the ornamental features 32 to seal the joints between and around each of the ornamental features 32 while the substrates 30 are in the unassembled configuration. With this design, the enclosure 18 can be quickly and easily formed and/or moved into the assembled configuration by simply installing each of the walls 26, i.e., each of the substrates 30, with the ornamental features 32 and the sealer 34 already affixed thereto, by securing each of the walls 26 to the base 20 in one application.

In an alternative embodiment, no ornamental features 32 are included in the enclosure 18. In yet another alternative embodiment, no sealer 34 is included between the ornamental features 32 of the enclosure 18.

Additionally, the present invention further provides additional stability and trueness by securing the enclosure 18 to the studs 14 through use of the attachment sleeves 16. More particularly, as described in detail herein, each attachment sleeve 16 can be secured to a corresponding stud 14 to provide a substantially planar and stable base against which the enclosure 18, i.e., the substrates 30, can be secured. With this design, the attachment sleeves 16 are able to effectively compensate for and/or overcome any imperfections or abnormalities that may otherwise be present in the studs 14.

It should be noted that, as illustrated in FIG. 1A, the base 20 and/or the curb 22 may also include a plurality of ornamental features 32 that are affixed thereto, with a sealer 34 provided between and/or around each of the ornamental features 32 that are affixed to the base 20 and/or the curb 22. Additionally, each of the side walls 26A, 268 may include a plurality of ornamental features 32 and sealer 34 that are affixed along a front-facing edge of the side walls 26A, 268. Stated in another manner, each of the side walls 26A, 268 may include bullnose ornamental features, e.g., bullnose tiles. Further, the ornamental features 32 that are affixed to the substrates 30, the base 20 and/or the curb 22 may be of any desired size or shape, and the size and shape of the individual ornamental features 32 can also be different from one another.

Further, in certain embodiments, the enclosure 18 can further include a wall alignment assembly 566 (illustrated, for example, in FIG. 5D) that is uniquely designed to ensure that each of the walls 26 can be properly aligned relative to the base 20 when the walls 26 are moved into the assembled configuration. For example, in some such embodiments, for each of the walls 26, the wall alignment assembly 566 can include a first alignment member 568 (illustrated, for example, in FIG. 5D) and a second alignment member 570 (illustrated in FIG. 5D) that are adapted to engage one another to ensure that the wall 26 is properly aligned relative to the base 20 when the wall 26 is in the assembled configuration.

Additionally, it should also be noted that while the disclosure provided herein focuses on the present invention being utilized as part of an enclosure 18 and/or as part of the formation of an enclosure 18, certain aspects of the present invention can additionally and/or alternatively be used for wall cladding and flooring in commercial and residential environments, and/or for other suitable purposes.

As noted above, each of the attachment sleeves 16 is sized and shaped to fit around and be selectively secured to a portion of one of the studs 14. Additionally, as noted, the attachment sleeves 16 are designed to provide a flat and stable base against which the enclosure 18, i.e., the substrates 30, can be secured in order to effectively compensate for and/or overcome any imperfections or abnormalities that may otherwise be present in the studs 14. In certain embodiments, the attachment sleeve 16 includes a first sleeve side 41F, a second sleeve side 41S and a front side 442 (illustrated in FIG. 4A). It is understood that either sleeve side 41F, 41S illustrated in FIG. 1A can be the first sleeve side or the second sleeve side. Further design aspects of various embodiments of the attachment sleeves 16 will be described in greater detail herein below.

The base 20 provides an area in which the user of the enclosure assembly 10 can be positioned during use. Additionally, the base 20 is designed to support certain other elements of the enclosure assembly 10. Further, as provided herein, the base 20 can be formed to be any desired size and shape. Still further design aspects of various embodiments of the base 20 will be described in greater detail herein below.

The curb 22 is adapted to be positioned along one side of the base 20. The curb 22 can be sized and shaped to allow for easy entrance into and exit from the enclosure 18 over the curb 22. Further, the curb 22 can inhibit water from exiting the enclosure in an unwanted manner. In alternate embodiments, the curb 22 can be integrally formed with the base 20, or the curb 22 can be formed separate!' from the base 20 and can be fixedly secured substantially adjacent, if not directly adjacent, to the base 20 when the curb 22 is positioned in the assembled configuration.

The wall assembly 24 is adapted to be coupled to and supported by the base 20 when the enclosure 18 is in the assembled configuration. The wall assembly 24 can include any desired number of walls 26, i.e., any desired number of substrates 30, depending on the desired shape of the enclosure 18. Additionally, the shape of each of the walls 26, i.e., the shape of each of the substrates 30, can be varied to suit the specified design requirements for the enclosure 18. For example, in the embodiment illustrated in FIG. 1A, the wall assembly 24 includes three walls 26, i.e., three substrates 30, that are substantially rectangular-shaped to form a substantially rectangular-shaped enclosure 18 with an opening along the front of the enclosure 18. More specifically, in this embodiment each of the walls 26 is at an angle relative to, i.e., perpendicular to, each of the adjacent walls 26. Further, when the enclosure 18 is in the assembled configuration, the top wall edge 27T provides, forms and/or substantially coincides with a top enclosure edge 18T of the enclosure 18. Alternatively, the enclosure 18 can be designed to be square-shaped, triangle-shaped, pentagon-shaped, hexagon-shaped, octagon-shaped, circle-shaped, oval-shaped, or another suitable shape.

The wall connectors 28 are designed to enhance the connection between adjacent walls 26 when the enclosure 18 is in the assembled configuration. Additionally, if a watertight enclosure 18 is desired, such as with a shower-type enclosure, the wall connectors 28 can also help to provide a watertight barrier to inhibit water from exiting the enclosure 18 and potentially causing damage to the frame 12 and/or other materials that may be positioned outside the enclosure 18.

For example, in this embodiment, the enclosure 18 includes two wall connectors 28, with one wall connector 28 being secured to and enhancing the connection between the first side wall 26A and the rear wall 26C, and the other wall connector 28 being secured to and enhancing the connection between the second side wall 268 and the rear wall 26C. Additionally, in this embodiment, the wall connectors 28 have a substantially L-shaped cross-section so as to better enable the formation of the rectangle-shaped enclosure 18, although the wall connectors 28 can be other shapes depending on the desired shape of the enclosure 18. Further, in different embodiments, the wall connectors 28 can extend part or substantially all of the height of the walls 26.

Additionally, in various embodiments, the wall connectors 28 can be made of any suitable materials. For example the wall connectors 28 can be made from and/or include plastic, rubber, metal or any other suitable materials.

Further, each of the substrates 30 can be formed as a lightweight, sturdy structure. In particular, each of the substrates 30 can be formed from one or more materials that can be used in combination to form a lightweight, sturdy structure that can also be water-resistant or waterproof to inhibit water from intruding into the wall studs 14. For example, in one embodiment, each of the substrates 30 can be formed from core extruded polystyrene rigid foam with fiber meshed polymer resin mortar coating added to both sides. With this design, the substrates 30 can provide a relatively lightweight, yet sturdy structure for use in the enclosure 18. Alternatively, other materials can be used to form the substrates 30 of the enclosure 18. For example, in one embodiment, another form of waterproof or water-resistant substrate can be used to form the substrates 30 of the enclosure 18.

By utilizing relatively lightweight substrates 30, as provided herein, potentially significant savings can be achieved to reduce shipping costs, as well as enabling easier assembly of the enclosure 18, as such lightweight materials are typically much easier to handle and maneuver Moreover, it should be noted that the ability to utilize such lightweight materials for the substrates is greatly enhanced due to the usage of the plurality of attachment sleeves 16 that provide the substantially planar, plumb and stable base against which the substrates 30 can be secured. By including the alignment sleeves 16 in the enclosure assembly 10, as described more fully below, it becomes unnecessary to use relatively heavy, rigid substrates that are much more difficult to handle and assemble due to their increased weight Because the alignment sleeves 16 create a more planar and plumb surface, the use of conventional, relatively heavy substrates for taking imperfections out of the wall studs 14 is obviated.

FIG. 1B is a partially exploded view of the enclosure assembly 10 Illustrated in FIG. 1A and a portion of the frame 12 to which the enclosure assembly 10 may be secured. In particular, FIG. 1B illustrates further details about the frame 12 and the various elements that cooperate and/or combine to form the enclosure assembly 10. For example, FIG. 1B illustrates a portion of the frame 12 including a plurality of studs 14, and the plurality of attachment sleeves 16 that are selectively secured to the studs 14 to provide a substantially planar, plumb and stable base against which the substrates 30 can be secured. Additionally, FIG. 1B also illustrates the various elements of the enclosure 18, i.e., the base 20 (with the curb 22 being integrally formed with the base 20 in this embodiment}, and the substrates 30, the ornamental features 32, the sealer 34, and the wall connectors 28 that make up the wall assembly 24, which can be selectively coupled to the base 20.

FIG. 2A is a simplified schematic illustration of an embodiment of an enclosure 218 having features of the present invention. As noted above, in certain embodiments, the enclosure 218 can be selectively movable between an unassembled configuration (as illustrated in FIG. 2A) and an assembled configuration (as illustrated in FIG. 2B). Additionally, the enclosure 218 can be used as part of the enclosure assembly 10 (illustrated in FIG. 1A). As illustrated in FIG. 2A, when the enclosure 218 is in the unassembled configuration, each of the base 220, the curb 222, the wall connectors 228, the one or more substrates 230, the plurality of ornamental features 232, and the sealer 234 are spaced apart and/or disconnected from one another.

In some alternative embodiments, the enclosure 218 can have a different design and/or can include different features or elements as compared to the embodiment 218 specifically illustrated in FIG. 2A For example, the enclosure 218 can be formed without the curb 222, and/or the enclosure 218 can include more or fewer substrates 230 than specifically illustrated in FIG. 2A. Additionally, it should be noted that the size and shape of the ornamental features 230 illustrated in FIG. 2A is merely for purposes of illustration, and the ornamental features 230 can have any desirable size and shape, The base 220 provides the bottom member of the enclosure 218 that is used to support at least some of the other elements of the enclosure 218 when the enclosure is in the assembled configuration. Further, the base 220 also supports the user of the enclosure 218. Additionally, the base 220 can provide other desired benefits depending on the type of enclosure that is being designed. For example, in one embodiment, the enclosure 218 can be a shower-type enclosure, and the base 220 can be a pre-sloped shower pan that is waterproof and that includes a drain 236 so that the water can effectively drain out of and away from the enclosure 218 through a series of pipes (not illustrated).

Further, the size and shape of the base 220 can be varied depending on the desired size and shape of the enclosure 218. For example, in one embodiment, as shown in FIG. 2A, the base 220 can be substantially square-shaped so as to enable the formation of a substantially square-shaped enclosure 218. Alternatively, the base 220 and/or the enclosure 218 can be designed to be rectangle-shaped, triangle-shaped, pentagon-shaped, hexagon-shaped, octagon-shaped, circle-shaped, oval-shaped, or another suitable shape.

Still further, in some embodiments, the base 220 can be formed of similar materials as are used to form the substrates 230. For example, in one embodiment, the base 220 can be formed from core extruded polystyrene rigid foam with a fiber meshed polymer resin mortar coating added to both sides. With this design, the base 220 can provide a relatively lightweight, yet sturdy structure for use in the enclosure 218. Alternatively, other materials can be used to form the base 220 of the enclosure 218. For example, in one embodiment, the base 220 can be made from one or more of fiberglass, plastic, composite, or other suitable waterproof materials.

Moreover, in alternative embodiments, the base 220 can have one or more ornamental features 232 affixed thereto, or the base 220 can be designed to be devoid of any ornamental features 232.

The curb 222 can be somewhat rectangular bar-shaped and is adapted to be positioned along one side of the base 220. Additionally, in one embodiment, the curb 222 can be a separate and distinct element from the base 220, and can be fixedly secured substantially adjacent, if not directly adjacent, to the base 220 when the curb 222 is positioned in the assembled configuration. Alternatively, in one embodiment, the curb 222 can be integrally formed with the base 220.

During use, the curb 222 allows for easy entrance into and exit from the enclosure 21R In particular, the curb 222 can be large enough to perform certain desired functions, yet small enough to allow the user of the enclosure 218 to easily step over the curb 222 during entrance to or exit from the enclosure 10. Additionally, in the case of a shower enclosure, a door (not illustrated) can be adapted to be positioned above and near and/or adjacent to the curb 222 when the enclosure is in the assembled configuration. With this design, the curb 222 and/or the door can function to inhibit water from spraying or splashing out of the enclosure 218 during use.

Further, in alternative embodiments, the curb 222 can have one or more ornamental features 232 affixed thereto, or the curb 222 can be designed to be devoid of any ornamental features 232.

As shown in FIG. 2A, when in the unassembled configuration, each of the substrates 230 is spaced apart and/or disconnected from one another and from the base 220. Additionally, in certain embodiments, the one or more substrates 230 can form a majority of the exterior of the enclosure 218, i.e., when the enclosure 218 is in the assembled configuration.

The number, size and shape of the substrates 230 can be varied to suit the specific design requirements for the enclosure 218. In the embodiment illustrated in FIG. 2A, the enclosure 218 includes three similarly sized substrates 230 that are selectively movable between the unassembled configuration and the assembled configuration. Additionally, in one embodiment, as illustrated in FIG. 2A, each of the one or more substrates 230 can be a substantially flat, rectangular-shaped substrate 230. Alternatively, the enclosure 218 can include greater than three substrates 230 or less than three substrates 230 depending on the desired shape of the enclosure 21R. Still alternatively, one or more of the substrates 230 can be curved and/or can have a different size or shape than the other substrates 230 depending on the specific design requirements for the enclosure 218.

Further, as provided above, each of the substrates 230 can be formed from one or more materials that can be used in combination to provide a lightweight, sturdy structure. For example, in one embodiment, each of the substrates 230 can be formed from core extruded polystyrene rigid foam with fiber meshed polymer resin mortar coating added to both sides. Alternatively, other materials can be used to form the substrates 230 of the enclosure 218. For example, in one embodiment, another form of waterproof substrate can be used to form the substrates 230 of the enclosure 218.

The plurality of ornamental features 232 are adapted to be fixedly secured to the one or more substrates 230, and/or to the base 220 and/or curb 222 of the enclosure 218. More particularly, each of the plurality of ornamental features 232 can be individually affixed to one of the substrates 230 (and or to the base 220 and/or the curb 222) of the enclosure 218 with a flexible adhesive. Moreover, each of the plurality of ornamental features 232 can be individually affixed to one of the substrates 230 (and/or to the base 220 and/or the curb 222) while the substrates 230 (and the base 220 and/or the curb 222) are in the unassembled configuration. Alternatively, some of the plurality of ornamental features 232 can be secured to one another before being affixed to one of the substrates 232 (and/or to the base 220 and/or the curb 222) of the enclosure 218.

As utilized herein, the ornamental features 232 can include ceramic tiles, glass tiles, porcelain tiles, metal tiles, marble tiles, stone, or other suitable material, and/or can include other suitable ornamental or decorative features. Additionally, the ornamental features 232 can be provided that have different shapes and sizes. For example, as shown in FIG. 2A, each of the ornamental features 232 can be a small square tile. Alternatively, for example, the ornamental features 232 can be medium-sized squares, large squares, and/or the ornamental features 232 can be any size that is rectangle-shaped, triangle-shaped, pentagon-shaped, hexagon-shaped, octagon-shaped, or some other shape.

Additionally, as provided herein, the sealer 234 can also be affixed to the substrates 230, i.e., between and around each of the plurality of ornamental features 232, while the substrates 230 are in the unassembled configuration. Further, in embodiments that include ornamental features 232 being secured to the base 220 and/or the curb 222, the sealer 234 can also be affixed to the base 220 and/or the curb 222, i.e., between and around each of the plurality of ornamental features 232, while the base 220 and/or the curb 222 are in the unassembled configuration.

FIG. 2B is a simplified schematic illustration of the enclosure 218 illustrated in FIG. 2A, with the enclosure 218 now being in the assembled configuration. In particular, FIG. 2B illustrates that the substrates 230 can be used to form a first side wall 226A, a second side wall 2268, and a rear wall 226C as the enclosure 218 is moved toward the assembled configuration. Moreover, when in the assembled configuration, each of the three walls 226A, 2268, 226C have been coupled to the base 220 such that the walls 226A, 2268, 226C are in a substantially upright position, e.g., vertical position, with the wall connectors 228 helping to secure adjacent walls 226A, 2268, 226C together. Further, in one embodiment the walls 226A, 2268, 226C can be coupled to the base 220 so as to provide a watertight connection. Additionally, at least one of the walls 226A, 2268, 226C can have a plurality of ornamental features 232 affixed thereto. Still further, as shown in FIG. 2B, the curb 222 has also been coupled to the base 220. With this design, the walls 226A, 2268, 226C formed from the substrates 230 cooperate with the base 2.20 and the curb 222 to form a substantially square-shaped enclosure 218 when the enclosure 218 is in the assembled configuration.

It should be noted that, pursuant to the teachings provided herein, the ornamental features 232 have been affixed to one or more of the substrates 230 prior to the substrates 230 being coupled to the base 220 in a substantially upright position, e.g., vertical position, i.e., prior to the substrates 230 being moved from the unassembled configuration to the assembled configuration. Further, the ornamental features 232 that have been affixed to the substrates 230 are shown to have an ornamental design 233 having ornamental features 232 that are positioned substantially adjacent to the top substrate edge 231T (also illustrated in FIG. 2A), the bottom substrate edge 231B (illustrated in FIG. 2A), the first lateral substrate edge 231F (illustrated in FIG. 2A) and the second lateral substrate edge 231S (illustrated in FIG. 2A). Moreover, in certain embodiments, the ornamental design 233 covers substantially one entire side of the substrate 30 and has a design perimeter 233P such that no additional ornamental features 232 are positioned within the design perimeter 233P after the substrate 2.30 has been moved to the assembled configuration.

Additionally, as shown in FIG. 2B, the enclosure 218 can include the sealer 234, i.e., grout or other adhesive material, which is provided between, behind and/or around each of the ornamental features 232 to seal the joints between and around all of the ornamental features 232 and/or adhere the ornamental features 232 to the substrates 230. Further, the sealer 234 can further be used to seal the joint between adjacent walls 226A, 2268, 226C of the enclosure 218 when the enclosure is in the assembled configuration. The sealer 234 can be formed from any suitable material. For example, in one embodiment, the sealer 234 can be formed from a water-resistant or waterproof material to provide a watertight seal between, behind and/or around each of the ornamental features 232, and/or between the adjacent walls 226A, 2.26B, 226G. Alternatively, the sealer 234 can include a standard grout mixture and/or can be formed from another suitable material such as an adhesive material. Moreover, pursuant to the teachings provided herein, the sealer 234 can be provided between the ornamental features 232 prior to the substrates 230 (i.e., the walls 226A, 226B, and 226C) being coupled to the base 220 in a substantially upright position, e.g., vertical position, i.e., prior to the walls 226A, 226B, 226C being moved from the unassembled configuration to the assembled configuration.

With the design and method as provided herein, the substrates 230 can quickly and easily be moved from the unassembled configuration to the assembled configuration (wherein the substrates 230 are coupled to the base 220 in a substantially upright position, e.g., vertical position) in one step, with the substrates 230 already fully adorned with as many ornamental features 232 as desired, and with the substrates 230 effectively sealed with the sealer 234 provided between and around all of the ornamental features 232.

Additionally, as noted above, it can be desired to utilize lightweight materials for the substrates 230. Moreover, in certain embodiments, the weight of the substrates 230 can be such that a particular ratio is established between the weight of the walls 226A, 2268, 226C, i.e., the weight of the substrates 230 with the ornamental features 232 and the sealer 234 affixed thereto, and the weight of the substrates 230 themselves. For example, in certain embodiments, the ratio of the weight of the individual wall 226A, 2268, 226C versus the weight of the respective substrate 230 can be between approximately 2:1 and 6:1. More specifically, in certain non-exclusive alternative embodiments, the ratio of the weight of the individual wall 226A, 226B, 226C versus the weight of the respective substrate 230 can be at least approximately 2:1, 2, 5:1, 3:1, 3.5:1, 4:1, 4.5:1, 5:1, 5.5:1 or 6:1. Alternatively, the ratio of the weight of the individual wall 226A 2268, 226C versus the weight of the respective substrate 230 can be greater than 6:1, less than 2:1, or some other value between 2:1 and 6:1.

Further, it should be noted that, in various embodiments, the weight of the sealer 234 relative to the weight of the ornamental features 232 is substantially negligible, such that the ratio of the combined weight of the substrate 230 and the ornamental features 232 that are affixed thereto versus the weight of the respective substrate 230 can also be between approximately 2:1 and 6:1.

Figure 3A:
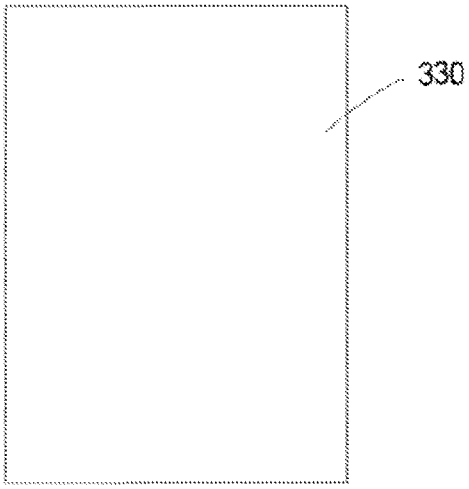
FIG. 3A is a simplified schematic illustration of an embodiment of a substrate having features of the present invention that is usable as part of the enclosure of FIG. 2A, there being no ornamental features affixed to the substrate.
Figure 3B:
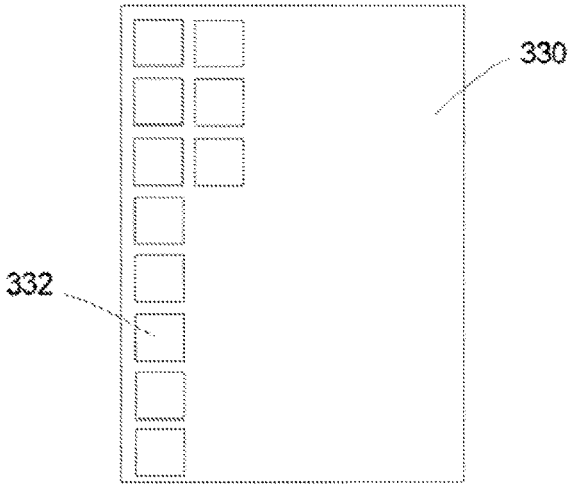
FIG. 3B is a simplified schematic illustration of the substrate illustrated in FIG. 3A, there being some ornamental features affixed to the substrate.
Figure 3C:
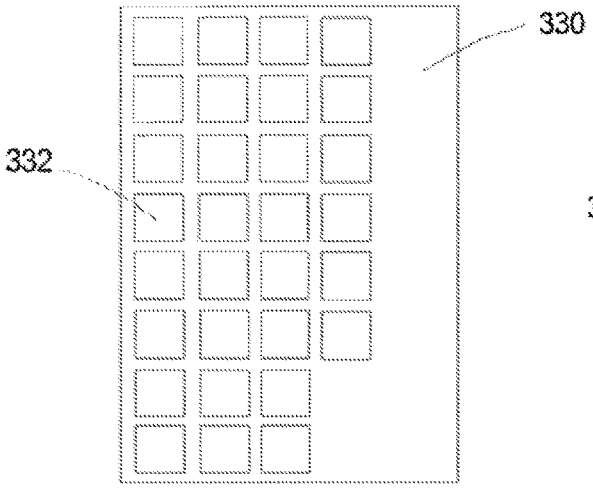
FIG. 3C is a simplified schematic illustration of the substrate illustrated in FIG. 3A, there being more ornamental features affixed to the substrate.
Figure 3D:
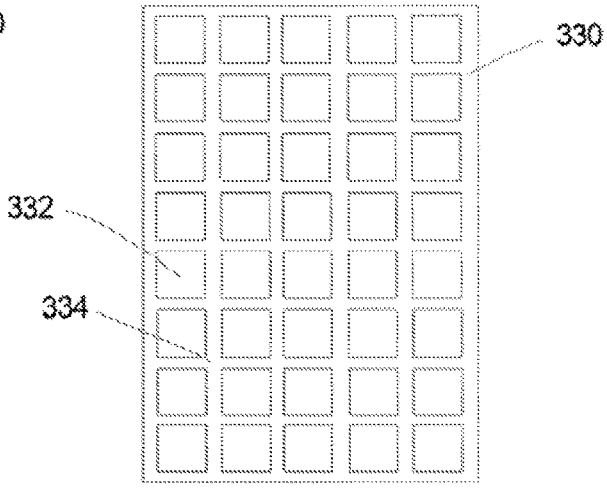
FIG. 3D is a simplified schematic illustration of the substrate illustrated in FIG. 3A, there being a full set of ornamental features and a sealer affixed to the substrate.

FIGS. 3A-3D are simplified schematic illustrations of an embodiment of a substrate 330 having features of the present invention that is usable as part of an enclosure, e.g., the enclosure 18 illustrated in FIG. 1A and/or the enclosure 218 illustrated in FIG. 2A More particularly. FIG. 3A is a simplified schematic illustration of an embodiment of the substrate 330, there being no ornamental features 332 affixed to the substrate 330; FIG. 3B is a simplified schematic illustration of the substrate 330 illustrated in FIG. 3A, there being some ornamental features 332 affixed to the substrate 330; FIG. 3C is a simplified schematic illustration of the substrate 330 illustrated in FIG. 3A, there being more ornamental features 332 affixed to the substrate 330: and FIG. 3D is a simplified schematic illustration of the substrate 330 illustrated in FIG. 3A, there being a full set of ornamental features 332, i.e., five columns of ornamental features 332 in this embodiment, affixed to the substrate 330.

As provided herein, as shown in FIGS. 38-30, the ornamental features 332 are being individually affixed to the substrate 330 while the substrate 330 is in an unassembled configuration, i.e., prior to the substrate 330 being coupled to a base, e.g., the base 20 in FIG. 1A For example, each of the plurality of ornamental features 332 can be truly individually, i.e., one-by-one, affixed to the substrate 330 while the substrate 330 is in the unassembled configuration. Alternatively, some of the plurality of ornamental features 332 can be secured to one another before being affixed to the substrate 330.

Additionally, as shown in FIG. 3D, a sealer 334 can be provided between and/or around each of the ornamental features 332 to seal the joints between and/or around the ornamental features 332 while the substrate 330 is in the unassembled configuration. Subsequently, the substrate 330, with the ornamental features 332 and the sealer 334 provided therewith, can be moved from the unassembled configuration into an assembled configuration wherein the substrate 330 will be coupled to the base 20 in a substantially upright position. With such design, the substrate 330 can quickly and easily be moved from the unassembled configuration to the assembled configuration in one step, with the substrate 330 already fully adorned with ornamental features 332 and sealed with the sealer 334 as desired.

Figure 4A:
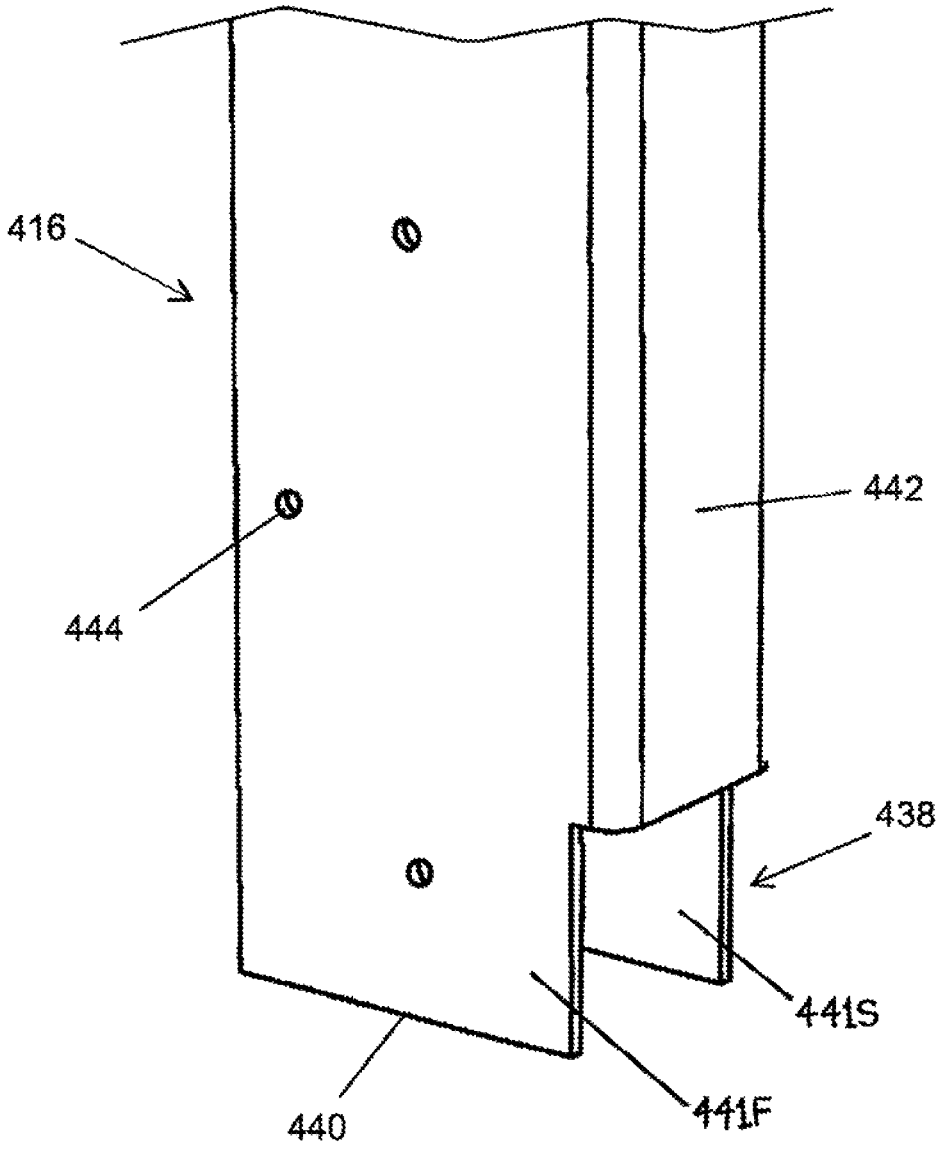
FIG. 4A is a perspective view of a portion of an embodiment of an attachment sleeve that is usable as part of the enclosure assembly of FIG. 1A.

FIG. 4A is a perspective view of a portion of an embodiment of an attachment sleeve 416 that is usable as part of the enclosure assembly 10 of FIG. 1A As provided herein, the attachment sleeve 416 is adapted to be secured to one of the studs 14 (illustrated, for example, in FIG. 1B) of the frame 12 (illustrated in FIG. 1B).

The design of the attachment sleeve 416 can be varied depending on the specific requirements of the enclosure assembly 10 and/or the stud 14 to which the attachment sleeve 416 is to be secured. In certain embodiments, as illustrated in FIG. 4A, the attachment sleeve 416 can generally have a substantially U-shaped or L-shaped cross-section that is specifically sized and shaped to fit around a portion of one of the studs 14. Alternatively, the attachment sleeve 416 can have a different configuration.

Additionally, as illustrated, the attachment sleeve 416 can include a notch 438 that is formed along a bottom edge 440, a first sleeve side 441F, a second sleeve side 441S, and a front edge 442 of the attachment sleeve 416. As described in greater detail herein below, the notch 438 is adapted to receive and/or engage a portion of a base, e.g., a flange 560 (illustrated in FIG. 5A) of the base 520 (illustrated in FIG. 5A). Further, it is understood that either sleeve side 441F, 441S illustrated in FIG. 4A can be the first sleeve side or the second sleeve side.

Further, in some embodiments, the attachment sleeve 416 can also include one or more apertures 444 (three are illustrated in the portion of the attachment sleeve 416 illustrated in FIG. 4A) that extend through the attachment sleeve 416 for receiving one or more attachers 446 (illustrated in FIG. 4B) for securing the attachment sleeve 416 to the stud 14. The apertures 444 can be included along both sides of the attachment sleeve for securing the attachment sleeve 4"16 to both sides of the stud 14.

Still further, the attachment sleeve 416 can be made from any suitable material. For example, in certain alternative embodiments, the attachment sleeve 416 can be made from stainless steel, other rust and/or corrosion resistant materials, or another suitable material.

Figure 4B:
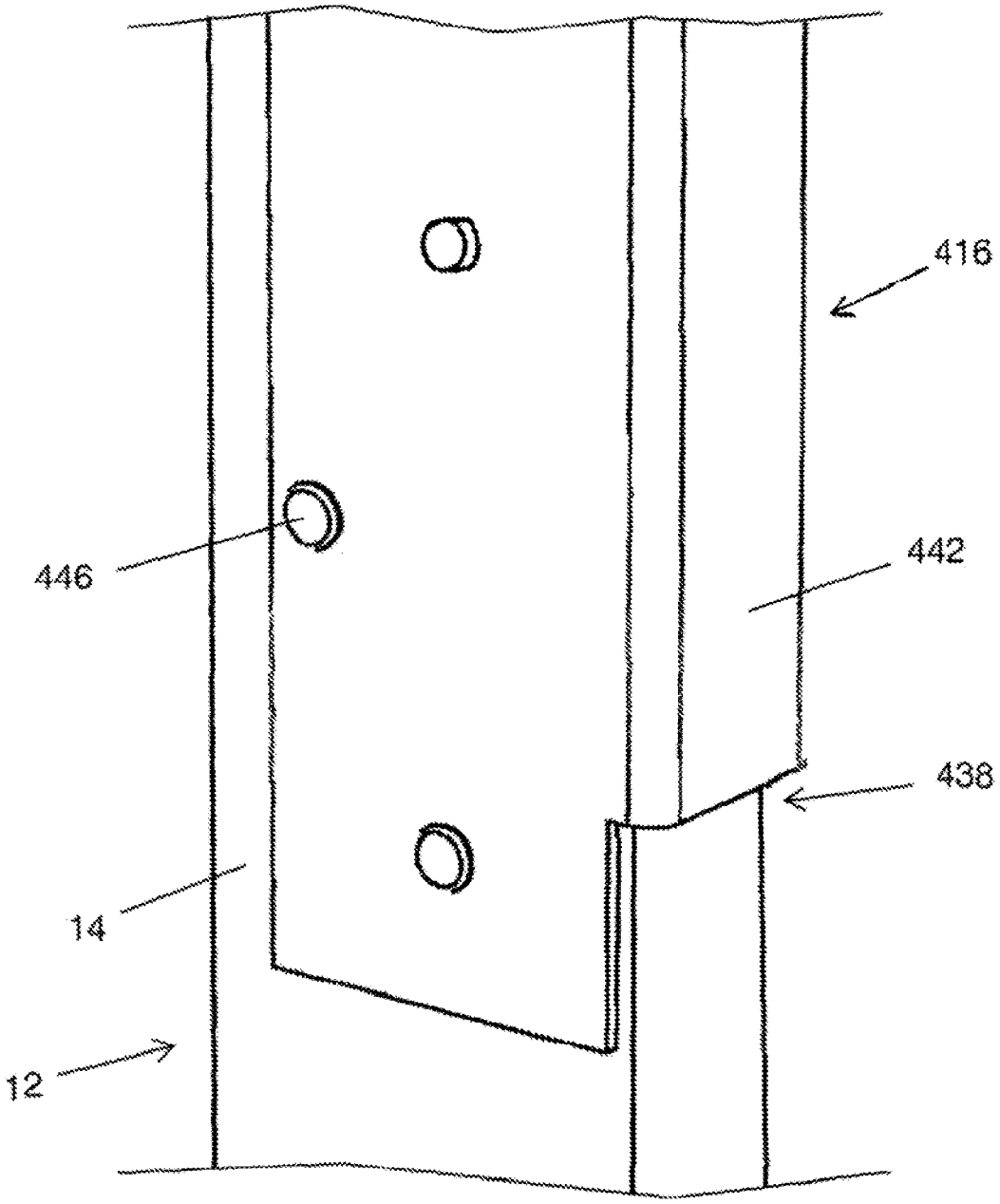
FIG. 4B is a perspective view of the portion of the attachment sleeve illustrated in FIG. 4A and a portion of a frame to which the attachment sleeve is affixed.

FIG. 4B is a perspective view of the portion of the attachment sleeve 416 illustrated in FIG. 4A and a portion one of the wall studs 14 of the frame 12 to which the attachment sleeve 416 is secured. As shown, one or more attachers 446 (three are illustrated in the portion of the attachment sleeve 416 illustrated in FIG. 4B) are shown as securing the attachment sleeve 416 to the stud 14. Each of the attachers 446 can extend through one of the apertures 444 (illustrated in FIG. 4A) formed into the attachment sleeve 416. In certain embodiments, the attachers 446 can be nails, screws, or another suitable type of attacher.

Additionally, as illustrated, the front edge 442 of the attachment sleeve 416 can be spaced apart from the stud 14. With this design, as described in greater detail herein below, the front edge 442 can be positioned to be substantially flush with a portion of the base 20, e.g., the flange 560 illustrated in FIG. 5A, that engages the notch 438 of the attachment sleeve 416 when the enclosure 18 is in the assembled configuration.

Moreover, as shown in FIG. 4B, the attachment sleeve 416 can be sized and or positioned so that the attachment sleeve 416 does not extend fully to a back edge of the stud 14. Alternatively, the attachment sleeve 416 can be designed and/or positioned such that a portion of the attachment sleeve 416 is substantially flush with the back edge of the stud 14, or such that a portion of the attachment sleeve 416 extends beyond the back edge of the stud 14.

Because the front edge 442 of the attachment sleeve 416 is formed so that the surface of the front edge is relatively smooth and planar, imperfections or other deviations in the wall studs 14 are rendered immaterial. Instead of attaching the substrate boards 30 directly to the studs 14, the substrate boards 30 are secured to the substantially planar, plumb and true attachment sleeves 416. As a result, the use of a significantly lighter weight substrates 30 is permissible and it is not necessary to rely on the use of heavier weight, more rigid substrates to cover up imperfections or deviations in the wall studs 14.

Figure 5A:
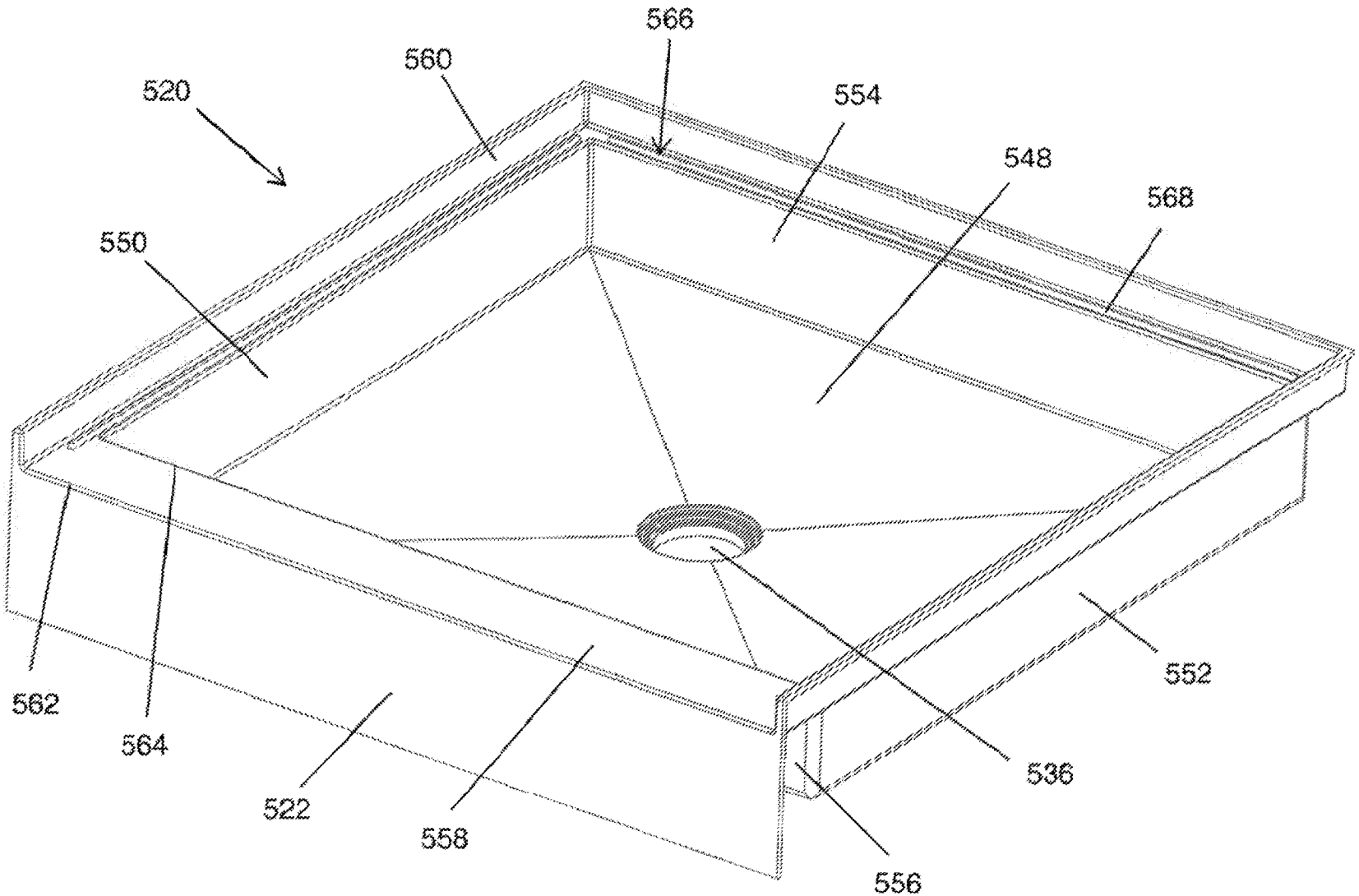
FIG. 5A is a top perspective view of an embodiment of a base that is usable as part of the enclosure of FIG. 2A.

FIG. 5A is a top perspective view of an embodiment of a base 520 that is usable as part of the enclosure 218 of FIG. 2A. The size, shape and design of the base 520 can be varied to suit the specific design requirements of the enclosure 218. As shown in the embodiment illustrated in FIG. 5A, the base 520 can be substantially rectangle-shaped, including a bottom 548, a first lateral side 550, a second lateral side 552, a rear side 554, and a front side 556. Additionally, the sides 550, 552, 554, 556 cooperate to form a ledge 558 along a top surface of the sides 550, 552, 554, 556. Further, a flange 560 extends in a generally upward direction from the ledge 558 along each of the first lateral side 550, the second lateral side 552 and the rear side 554. Moreover, in this embodiment, no flange is included along the front side 556 of the base 520. Still further, as illustrated, the base 520 can include a curb 522 that is integrally formed with the base 520 substantially adjacent to the front side 556.

In this embodiment, the bottom 548 of the base 520 is substantially rectangle- or square-shaped. Additionally, as illustrated, the base 520 can be designed for a shower-type enclosure, such that the bottom 548 is generally sloped from the edges toward a drain 536 so that the water can effectively drain out of and away from the base 520 through a series of pipes (not illustrated). Alternatively, the bottom 548 can have a different shape. For example, the bottom 548 can be triangle-shaped, pentagon-shaped, hexagon-shaped, octagon-shaped, circle-shaped, oval-shaped, or another suitable shape. Still alternatively, the bottom 548 of the base 520 need not be sloped, i.e., the bottom 548 can be substantially flat.

In the embodiment illustrated in FIG. 5A, adjacent sides 550, 552, 554, 556 are at approximately right angles relative to one another, i.e., are substantially perpendicular to one another, for the formation of the substantially rectangle-shaped base 520. Additionally, opposing sides 550, 552, 554, 556 are substantially parallel to one another. In particular, (i) the first lateral side 550 is substantially perpendicular to both the rear side 554 and the front side 556, and is substantially parallel to the second lateral side 552; (ii) the second lateral side 552 is substantially perpendicular to both the rear side 554 and the front side 556, and is substantially parallel to the first lateral side 550; (iii) the rear side 554 is substantially perpendicular to both the first lateral side 550 and the second lateral side 552, and is substantially parallel to the front side 556; and (iv) the front side 556 is substantially perpendicular to both the first lateral side 550 and the second lateral side 552, and is substantially parallel to the rear side 554. Alternatively, the base 520 can include a different number of sides and/or the sides 550, 552, 554, 556 can have a different orientation relative to one another.

The ledge 558 is substantially horizontal and can be substantially parallel to a surface (not illustrated), e.g., the floor, on which the enclosure 218 is mounted. Additionally, in some embodiments, the ledge 558 can be slightly downwardly sloped from an outer edge 562 to an inner edge 564 to better enable water to flow toward the bottom 548 of the base 520.

As illustrated, the flange 560 can extend in a generally upward direction from near and/or along the outer edge 562 of the ledge 558 along each of the first lateral side 550, the second lateral side 552 and the rear side 554. The flange 560 is designed to engage the notch 438 (illustrated in FIG. 4A) of each attachment sleeve 416 (illustrated in FIG. 4A) as well as a portion of the walls 26 (illustrated in FIG. 1A) that are coupled to and/or mounted on the base 520. More particularly, the flange 560 along the first lateral side 550 is positioned to engage the first side wall 26A (illustrated in FIG. 1A), the flange 560 along the second lateral side 552 is positioned to engage the second side wall 268 (illustrated in FIG. 1A), and the flange 560 along the rear side 554 is positioned to engage the rear wall 26C {illustrated in FIG. 1A), when the walls 26A, 26B, 26C are moved from the unassembled configuration to the assembled configuration.

Additionally, as shown in FIG. 5A, a portion of the wall alignment assembly 566 can be integrally formed on the ledge 558 along each of the first lateral side 550, the second lateral side 552 and the rear side 554. In particular, a first alignment member 568 can be integrally formed on the ledge 558 along each of the first lateral side 550; the second lateral side 552 and the rear side 554. The first alignment member 568 is adapted to engage a second engagement member 570 (illustrated in FIG. 5D) that can be integrally formed along a bottom edge of each of the walls 26A, 26B, 26C. Alternatively, the first alignment members 568 can be separately formed and fixedly secured to the ledge 558, and/or the second alignment members 570 can be separately formed and fixedly secured to a bottom edge of each of the walls 26A, 268, 26C.

Figure 5B:
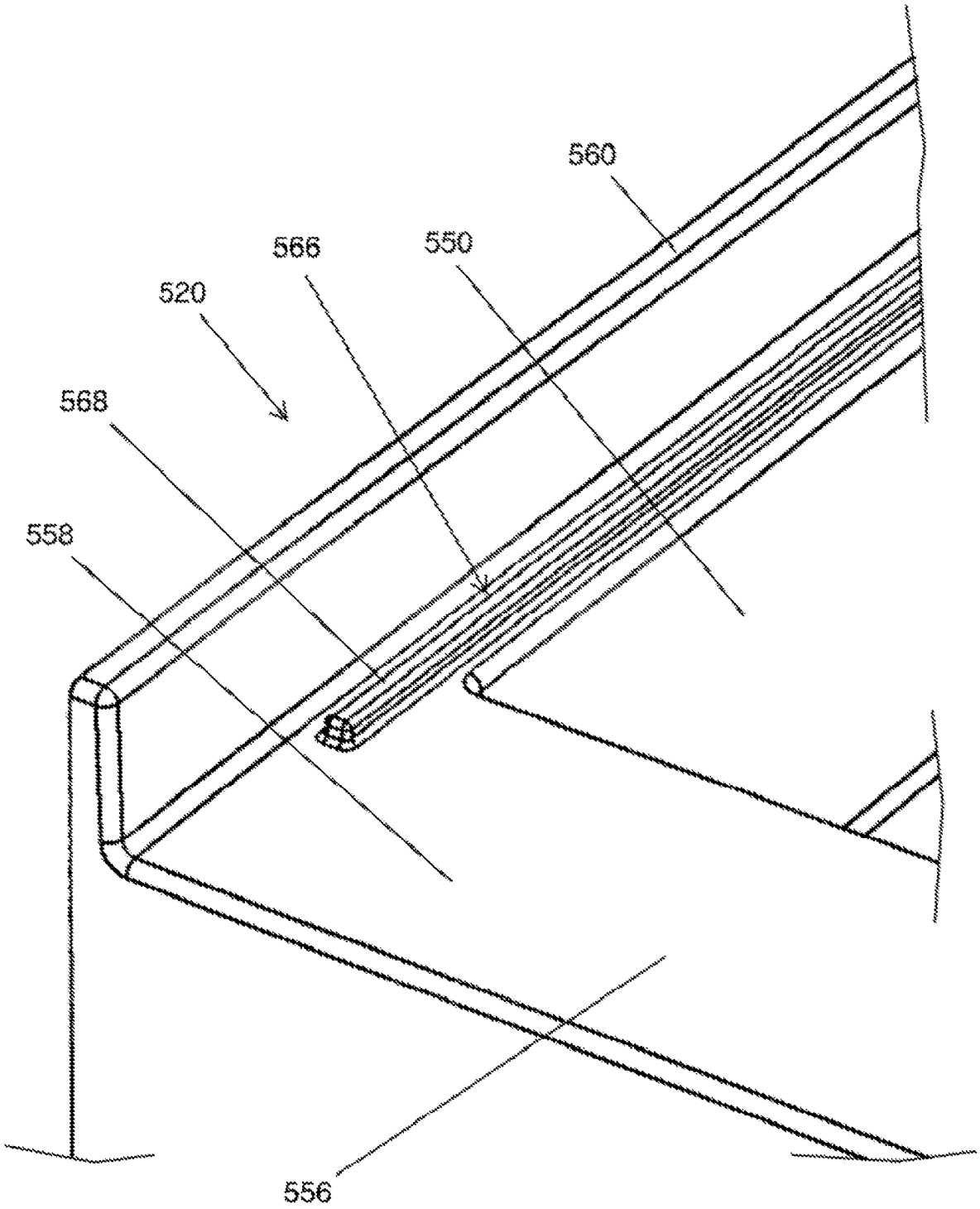
FIG. 5B is an enlarged perspective view of a portion of the base illustrated in FIG. 5A.

FIG. 5B is an enlarged perspective view of a portion of the base 520 illustrated in FIG. 5A. In particular, FIG. 5B provides an enlarged view, and thus illustrates further details, of a portion of the first lateral side 550, the front side 556, the ledge 558, the flange 560, and the first alignment member 568 of the wall alignment assembly 566.

Figure 5C:
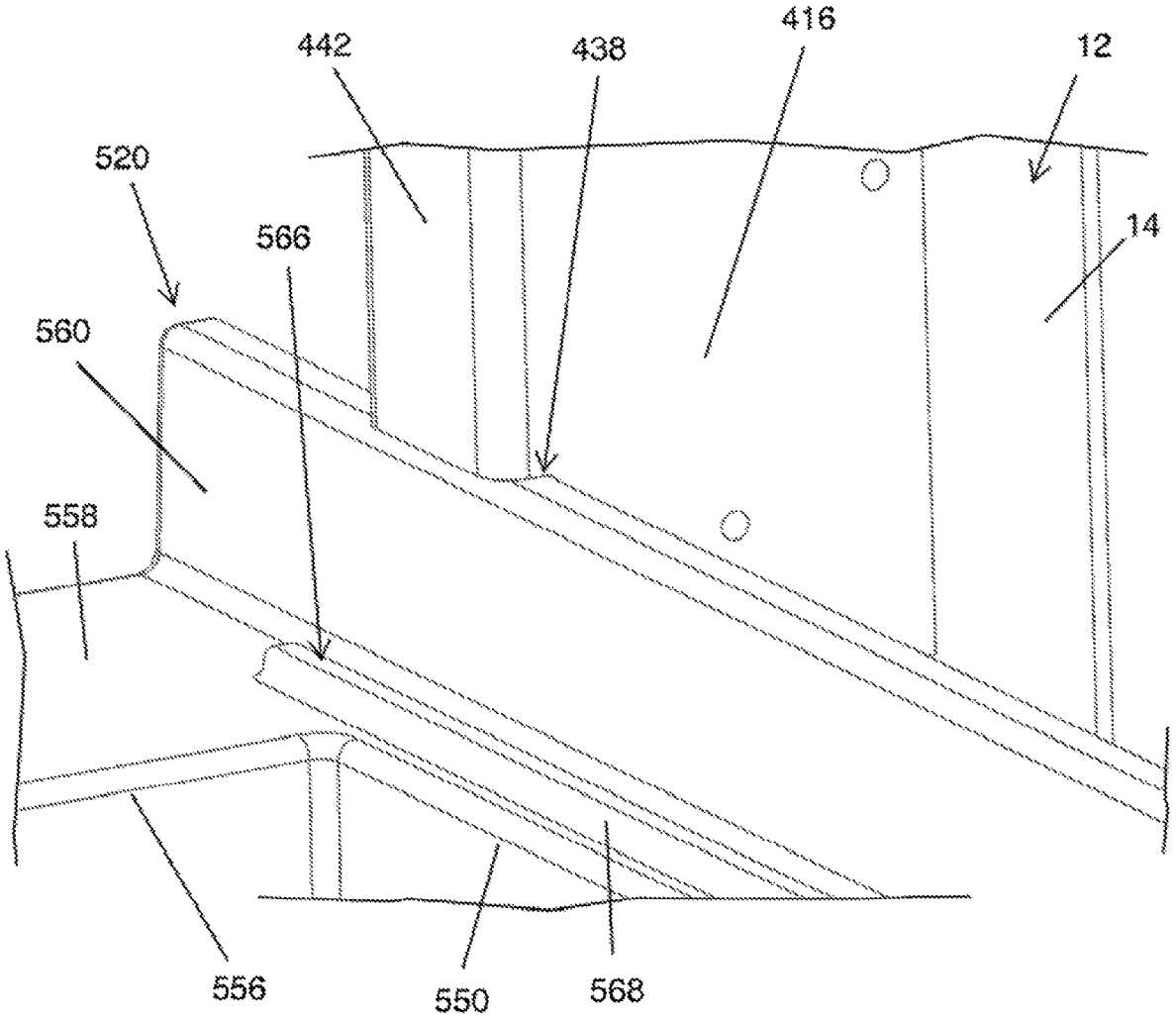
FIG. 5C is another enlarged perspective view of a portion of the base illustrated in FIG. 5A, and a portion of the attachment sleeve and the frame of FIG. 4B.

FIG. 5C is another enlarged perspective view of a portion of the base 520 illustrated in FIG. 5A, and a portion of the attachment sleeve 416 and the frame 12 of FIG. 4B. More particularly, similar to FIG. 5B, FIG. 5C again illustrates a portion of the first lateral side 550, the front side 556, the edge 558, the flange 560, and the first alignment member 568 of the wall alignment assembly 566.

Additionally, FIG. 5C further illustrates the attachment sleeve 416 that has been mounted on and secured to the stud 14. Further, FIG. 5C also illustrates how when the flange 560 of the base 520 engages the notch 438 of the attachment sleeve 416, the front edge 442 of the attachment sleeve 416 can be substantially flush with the front face 572 (illustrated in FIG. 5D) of the flange 560.

Figure 5D:
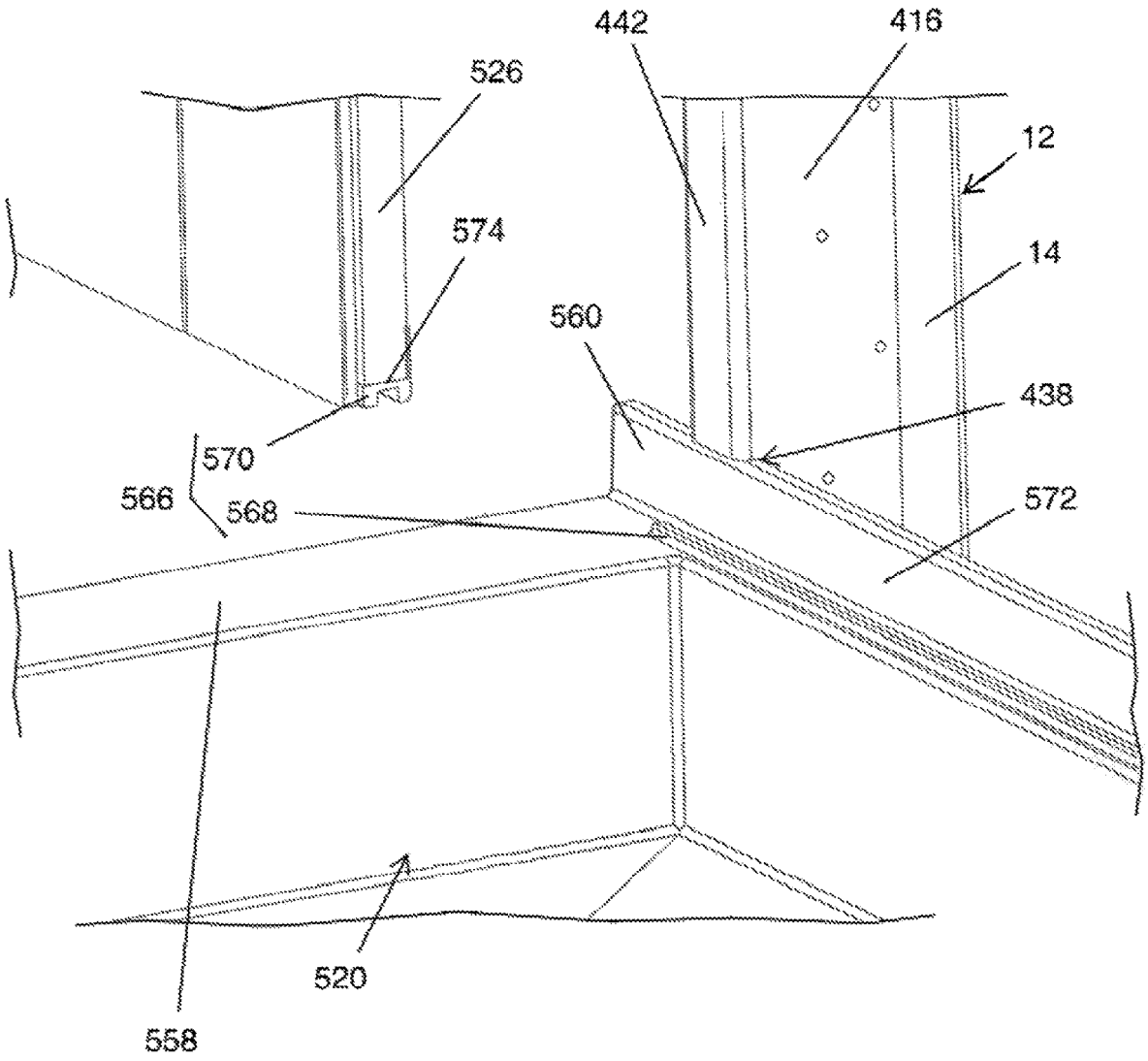
FIG. 5D is an enlarged view of a portion of the base, the attachment sleeve and the frame illustrated in FIG. 5C, and a portion of a wall that is to be aligned on the base and secured to the attachment sleeve.

FIG. 5D is an enlarged perspective view of a portion of the base 520, the attachment sleeve 416, and the frame 12 illustrated in FIG. 5C, and a portion of a wall 526 that is to be aligned on and coupled to the base 520 and secured to the attachment sleeve 416. Similar to FIG. 5C, FIG. 5D illustrates that when the attachment sleeve 416 has been mounted on and secured to the stud 14, and when the flange 560 of the base 520 engages the notch 438 of the attachment sleeve 416, the front edge 442 of the attachment sleeve 416 can be substantially flush with the flange 560. With this design, when the wall 526 is secured to the front edge 442 of the attachment sleeve 416, e.g., with some type of liquid adhesive or other appropriate adhesive material, the wall 5.26 also extends along a front face 572 of the flange 560. Accordingly, the wall 526 can be effectively positioned adjacent to and/or be fixedly secured to a fully flat surface that includes both the front edge 442 of the attachment sleeve 416 and the front face 572 of the flange 560.

Additionally, FIG. 5D also illustrates further details regarding the wall alignment assembly 566. In particular, in this embodiment, the first alignment member 568 can be integrally formed with (or fixedly secured to) the ledge 558 of the base 520 and the second alignment member 570 can be integrally formed with (or fixedly secured to) a bottom edge 574 of the wall 526. During assembly, the wall 526 is moved toward the base 520 and the second alignment member 570 engages the first alignment member 568. With the alignment members 568, 570 effectively and appropriately engaged with one another, the wall 526 is properly aligned relative to the base 520.

As shown, in one embodiment, the first alignment member 568 can be an elongated projection that extends along a portion or substantially all of the length of the ledge 558 along the sides of the base 520. Further, in such embodiment, the second alignment member 570 can be an elongated groove or slot that is sized and shaped to receive the first alignment member 568, i.e., the elongated projection. The engagement between the first alignment member 568 and the second alignment member 570 helps to ensure that the walls 526 are properly aligned relative to the base 520 so as to provide a high-quality finished product Alternatively, in one embodiment, the first alignment member 568 can be an elongated groove and the second alignment member 570 can be an elongated projection that fits within and engages the elongated groove. Still alternatively, the alignment members 568, 570 can have a different design and/or the alignment members 568, 570 can be positioned differently relative to the base 520 and the wall 526 as compared to what is shown in FIG. 5D.

Moreover, it should be noted that with the design of the enclosure, e.g., the enclosure 18 illustrated in FIG. 1A, the flange 560 and the wall alignment assembly 566 cooperate to form an effective water barrier for any water that may otherwise escape from the enclosure 18. In particular, any water that is sprayed or splashed along any of the walls 526, to escape from the enclosure, the water must go under the second alignment member 570 (between the ledge 558 and the second alignment member), over the first alignment member 568, under the second alignment member 570 a second time, and then up and over the flange 560 (between the flange 560 and the attachment sleeve 416).

Figure 6:
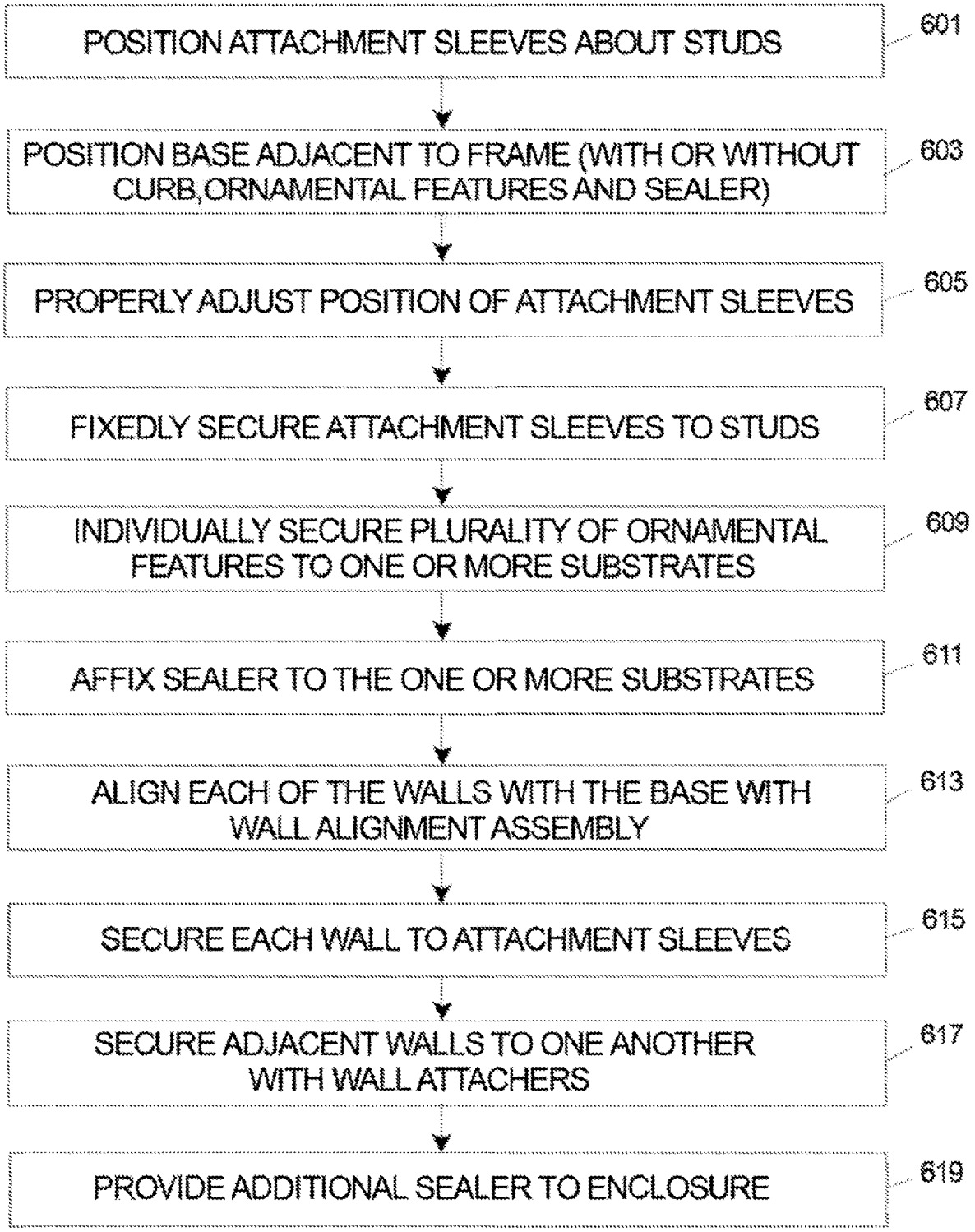
FIG. 6 is a flow chart that illustrates the steps for securing an enclosure assembly having features of the present invention to a frame.

FIG. 6 is a flow chart that illustrates the steps for securing an enclosure assembly having features of the present invention to a frame It should be noted that although the steps for securing the enclosure assembly to the frame are presented in a particular order herein, the order of the steps can be rearranged, one or more steps can be combined or omitted, and additional steps can be added without altering the intended breadth and scope of the present invention.

In step 601, one or more attachment sleeves are positioned around one or more studs of the frame.

In step 603, the base of the enclosure assembly is positioned substantially adjacent to the frame. In alternative embodiments, the base may include a curb that has been integrally formed with the base, a curb may be secured to the base before or after the base is positioned substantially adjacent to the frame, or the enclosure assembly may be designed without a curb. Additionally, the base (and/or the curb) may include one or more ornamental features and sealer that have been affixed to the base (and/or the curb) as desired, and such ornamental features and sealer may be affixed to the base (and/or the curb) before or after the base has been positioned substantially adjacent to the frame.

In step 605, the position of the attachment sleeves is adjusted, as necessary, such that a notch of the attachment sleeves accurately engages the flanges of the base with the front edge of the attachment sleeves being substantially flush with the front face of the flanges. It is understood that step 601 can be omitted in its entirety or otherwise combined with step 605.

In step 607, once the attachment sleeves have been properly positioned per step 605, the attachment sleeves are then fixedly secured to the studs of the frame.

In step 609, a plurality of ornamental features are individually fixedly secured to one or more substrates. This step is performed while the substrates are in an unassembled configuration, i.e., with the substrates not being coupled to the base.

In step 611, a sealer is affixed to the substrates between and/or around each of the plurality of ornamental features to effectively seal the joints between and around each of the ornamental features. This step can also be performed while the substrates are in the unassembled configuration. Alternatively, this step can be performed after the substrates have been mounted, adhered and/or secured to the attachment sleeves. As provided herein, once the ornamental features and the sealer have been affixed to the substrates, each of the substrates can then be referred to as a wall.

In step 613, each of the walls is aligned with the base with a wall alignment assembly. In particular, each of the walls can be aligned with the base by lining up and engaging a first alignment member of the base with a second alignment member of the wall.

In step 615, each of the walls is secured to one or more of the attachment sleeves such that a portion of each of the walls is substantially adjacent to one of the flanges of the base. It should be noted that the walls can be aligned with the base and secured to the attachment sleeves in any desired order. For example, in one non-exclusive embodiment when forming a substantially rectangle-shaped enclosure, the rear wall may be aligned with the base and secured to the attachment sleeves first prior to aligning and securing each of the side walls.

In step 617, adjacent walls can be secured to one another with one or more wall attachers. In one alternative embodiment, steps 615 and 617 can be performed substantially simultaneously. The wall attachers can be fixedly secured to each of the adjacent walls with any suitable method, such as by adhesive, staples or other fasteners, or by another suitable method. Moreover, the wall attachers can be secured to one of the adjacent walls prior to aligning the wall with the base and securing the wall to the attachment sleeves. More particularly, again using the example of the rectangle-shaped enclosure, a wall attacher can be secured along each vertical edge or the rear wall prior to the rear wall being aligned with the base and securing the rear wall to the attachment sleeves. Subsequently, as each of the side walls is aligned and secured, the side walls can also be secured to the rear wall at the same time.

In step 619, additional sealer may be provided as desired, e.g., between adjacent walls, to finalize the formation of the enclosure.

While a number of exemplary aspects and embodiments of an enclosure assembly 10 and an enclosure 18 have been discussed above, those skilled in the art will recognize certain modifications, permutations, additions and sub-combinations thereof It is therefore intended that the following appended claims and claims hereafter introduced are interpreted to include all such modifications, permutations, additions and sub-combinations as are within their true spirit and scope.

The invention claimed is:

1. A method for attaching a shower wall to a wall frame, the wall frame having a plurality of studs extending vertically, the method comprising:

attaching a plurality of attachment pieces to the stud of the wall frame, each attachment piece having, a front planar portion, so that the front planar portions of the plurality of attachment pieces are essentially co-planar and plumb regardless of whether the front-facing surfaces of the studs are co-planar, plumb, and straight;

attaching a lower piece of the shower wall to a plurality of attachment pieces on the wall frame; and attaching an upper piece of the shower wall to a plurality of attachment pieces on the wall frame, wherein the upper piece is aligned to the lower piece by a mating connection wherein a first alignment member proximate a top portion of the lower piece mates with a second alignment member near a bottom portion of the upper piece, and wherein the first and second alignment members are configured to mate together in at least a partially interlocking manner, whereby the upper piece is aligned with the lower piece regardless of whether the wall frame studs are co-planar and plumb.

2. The method of claim 1, wherein the attachment sleeve comprises two side planar portions oriented transverse to the front planar portion, such that the attachment sleeve has a U-shaped cross section, and wherein attaching an attachment pieces to a stud comprises fastening one or more of the two side planar portions to the stud.

3. The method, of claim 2, wherein the two side planar portions are spaced apart by a width that accommodates a width of the studs between the two side planar portions, and wherein a stud fits between the two side planar portions of the attachment sleeve.

4. The method of claim 3, wherein the side planar portion of the attachment sleeve comprises a plurality of apertures to accommodate attachers to connect the side planar portion to a stud through the apertures, and wherein fastening one or more of the two side planar pardons to the stud comprises using an attacher through an aperture.

5. The method of claim 4, wherein the attachers are nails.

6. The method of claim 4, wherein the attachers are screws.

7. The method of claim 1, wherein the first alignment member comprises a tongue, and wherein the second alignment member comprises a groove.

8. The method of claim 1, wherein the first alignment member comprises a groove, and wherein the second alignment member comprises a tongue.

9. The method of claim 1, wherein the lower piece further comprises a flange positioned behind the first alignment member.

10. The method of claim 9, wherein the flange is fabricated to provide a harrier to water intrusion and located behind the first alignment member away from the source of the water.

11. The method of claim 1, wherein at least one of the lower piece or the upper piece comprises a substrate with a plurality of ornamental features pre-attached.

12. The method of claim 11, wherein the substrate comprises polystyrene rigid foam.

13. The method of claim 11, wherein the substrate comprises one or more fiber meshed polymer resin mortar coatings.

14. The method of claim 11, wherein the ornamental features are tile.

15. The method of claim 11, wherein the ornamental features are tile, the tile cover all visibly exposed portions of the substrate and the second alignment member of the upper piece when mated to the first alignment member; and wherein the tile attached to the lower piece is left short of the tile attached to the upper piece when second alignment member is mated to the first alignment member leaving a gap, the method further comprising filling the gap with a sealer or grout.

16. The method of claim 1, further comprising:

installing a pre-made shower floor; and attaching a the lower piece to the shower, wherein the lower piece is aligned to shower floor by a mating connection wherein a first alignment member proximate a top portion of shower floor mates with a second alignment member near, a bottom portion of the lower piece, and wherein the first and second alignment members are configured to mate together in at least a partially interlocking manner.

* * * * *